US005246224A

United States Patent [19]

Matsuno et al.

[11] Patent Number: 5,246,224

[45] Date of Patent: Sep. 21, 1993

[54] METHOD AND DEVICE FOR CORRECTING ATTITUDE OF TRANSFERRED SHEET

[75] Inventors: Junichi Matsuno, Toride; Mitsuyoshi Satoo, Ibaraki, both of Japan

[73] Assignees: Hitachi, Ltd.; Hitachi Koki Co Ltd., both of Tokyo, Japan

[21] Appl. No.: 621,895

[22] Filed: Dec. 4, 1990

[30] Foreign Application Priority Data

Dec. 7, 1989 [JP] Japan ..... 1-318395

[51] Int. Cl.[5] ..... B65H 9/04

[52] U.S. Cl. ..... 271/242; 271/188; 271/266

[58] Field of Search ..... 271/242, 243, 266, 188; 355/317; 251/1

[56] References Cited

U.S. PATENT DOCUMENTS 4,878,657 11/1989 Ura et al. ..... 271/242
4,990,011 2/1991 Underwood et al. ..... 271/242

FOREIGN PATENT DOCUMENTS 58-144036 8/1983 Japan .
62-38261 8/1987 Japan .
259944 11/1987 Japan ..... 271/242
63-42648 3/1988 Japan .
180645 7/1988 Japan ..... 271/242

*Primary Examiner*—H. Grant Skaggs
*Attorney, Agent, or Firm*—Antonelli, Terry, Stout & Kraus

[57] ABSTRACT

A method for correcting a direction of a side of a transferred sheet in which according to a first step the sheet is driven forward at a driven portion thereof other than a forward end thereof when a pair of feed rollers contacting with each other to form a contacting line therebetween is rotationally stopped, until the forward end of the sheet contacts with the pair of feed rollers near to the contacting line and a curvature of the sheet is formed between the forward end and the driven portion with a clearance over a guide for the sheet so that a rigidity of the sheet against the curvature thereof generates a pressing force between the forward end of the sheet and the pair of feed rollers. In accordance with a second step in which thereof, after the first step, the pair of feed rollers is rotated in the backward direction so that the forward end of the sheet is urged backward and the curvature of the sheet is maintained with the clearance over the guide for the sheet, and a third step in which after the second step, the pair of feed rollers is rotated in the forward directing so that the sheet is fed forward.

19 Claims, 5 Drawing Sheets

METHOD AND DEVICE FOR CORRECTING ATTITUDE OF TRANSFERRED SHEET

BACKGROUND OF THE INVENTION AND RELATED ART STATEMENT

The present invention relates to a method and device for correcting an attitude of a transferred sheet-shaped work piece and, more particularly, to a method and device for correcting a direction of a side of the transferred sheet-shaped work piece.

Japanese Patent Unexamined Publication No. 58-144036 discloses a device correcting a direction of a side of a transferred paper, in which device the direction of the side of the transferred paper is corrected by contacting a forward side of the paper with a positioning member and subsequently the corrected forward side of the paper proceeds to a pair of feed rollers.

Japanese Utility Model Unexamined Publication No. 63-42648 discloses a device correcting a direction of a side of a transferred paper in which device the direction of the side of the transferred paper is corrected by making a curvature of the paper in a transferring direction and by contacting a forward side of the paper with a pair of feed rollers and subsequently the paper is transferred by the pair of feed rollers.

Japanese Patent Examined Publication No. 62-38261 discloses a device correcting a direction of a side of a transferred paper, in which device the paper passes between a pair of feed rollers in accordance with forward rotations of the feed rollers, subsequently backward rotations of the feed rollers make a curvature of the paper in a transferring direction and releases an engagement between the paper and the pair of feed rollers so that the direction of the side of the transferred paper is corrected by contacting the side of the paper with the pair of feed rollers and subsequently the paper is transferred by the pair of feed rollers.

OBJECT AND SUMMARY OF THE INVENTION

The object of the present invention is to provide a method and device for correcting a direction of a side of a transferred sheet, in which method and device an accuracy of correcting the direction of the side of the transferred sheet is improved in comparison with the conventional devices as described above and a time needed for making the correction is short. The present invention is suitable for being applied to a sheet-shaped soft work-piece transferring device, or more particularly to a printing machine with a paper transferring device.

According to the present invention, a method for correcting a direction of a side of a transferred sheet comprises:

a first step in which the sheet is driven forward at a driven portion thereof other than a forward end thereof when a pair of feed rollers contacting with each other to form a contacting line therebetween is rotationally stopped, until the forward end of the sheet contacts with the pair of feed rollers near to the contacting line and a curvature of the sheet is formed between the forward end and the driven portion with a clearance over a guide for the sheet so that a rigidity of the sheet against the curvature thereof generates a pressing force between the forward end of the sheet and the pair of feed rollers, a second step in which after the first step, the pair of feed rollers is rotated in a backward direction so that the forward end of the sheet is urged backward and the curvature of the sheet is maintained with the clearance over the guide for the sheet, and a third step in which after the second step, the pair of feed rollers is rotated forward so that the sheet is fed forward.

According to the present invention, a device for correcting a direction of a side of a transferred sheet comprises a pair of feed rollers contacting with each other to form a contacting line therebetween and supply means arranged apart from the contacting line and pressing the sheet forward so that a forward end of the sheet is moved toward the contacting line, wherein the supply means presses the sheet forward when the pair of feed rollers is rotationally stopped, until a forward end of the sheet contacts with the pair of feed rollers near to the contacting line and a curvature of the sheet is formed with a clearance over a guide for the sheet so that a rigidity of the sheet against the curvature of the sheet generates a pressing force between the sheet and the pair of feed rollers, thereafter, the pair of feed rollers is rotated in the backward direction so that the forward end of the sheet is urged backward and the supply means maintain the curvature of the sheet with the clearance over the guide for the sheet, and thereafter, the pair of feed rollers is rotated forward so that the sheet is fed forward.

In the present invention, when the pair of feed rollers is rotationally stopped, the sheet is pressed forward until the forward end of the sheet contacts with the pair of feed rollers near to the contacting line and the curvature of the sheet is formed. In order to correct the direction of the side of the sheet, it is necessary to contact at least two portions of the side of the sheet with the pair of feed rollers. In actuality, however, on a first contact between the forward end of the sheet and the pair of feed rollers, only one portion of the side of the sheet can contact with the pair of feed rollers and it is difficult for two portions of the side of the sheet to contact with the pair of feed rollers. More in detail, two ends on a thickness of the one portion of the side of the sheet contact with the feed rollers respectively. Since the one portion of the side of the sheet is fitted or pressed into a wedge-shaped clearance between the feed rollers, it is difficult for the side of the sheet to be moved by the rigidity against the curvature of the sheet so that at least two portions of the side of the sheet contact with the pair of feed rollers. Thereafter, when the pair of feed rollers is rotated in the backward direction and the supply means maintains the curvature of the sheet, a frictional force urging the forward end of the sheet backward is applied by the pair of feed rollers to the one portion of the side of the sheet fitted in the wedge-shaped clearance. Since the frictional force by the pair of feed rollers decreases largely after the one portion of the side of the sheet leaves slightly from surfaces of the pair of feed rollers and a speed of the one portion of the side of the sheet is zero before a secure fitting between the one portion of the side of the sheet and the pair of feed rollers in the wedge-shaped clearance is released or just before the one portion of the side of the sheet leaves slightly from the surfaces of the pair of feed rollers, the one portion of the side of the sheet cannot leave largely from the contacting line. Therefore, when the pair of feed rollers is rotated in the backward direction and the supply means maintain the curvature of the sheet, a force holding the one portion of the side of the sheet decreases largely and a position of the one portion of the side of the sheet is stable or stationary so that the side of the sheet can be moved easily and stably by the rigidity against the curvature of the sheet to contact at least two portions of the side of the sheet with the pair of feed rollers.

According to the present invention, the one portion of the side of the sheet contacting with the feed rollers is substantially stationary when the direction of the side of the sheet is corrected or another portion of the side of the sheet moves to contact with the feed rollers. Therefore, a time for stabilizing the position of the one portion of the side of the sheet contacting with the feed rollers when the pair of feed rollers rotates in the backward direction may be small and the movement of the another portion of the side of the sheet is smooth, so that the accuracy of correcting the direction of the side of the transferred sheet is improved in comparison with the conventional devices and the time needed for making the correction is short.

DETAILED DESCRIPTION OF PREFERRED EMBODIMENTS

Figure 1:
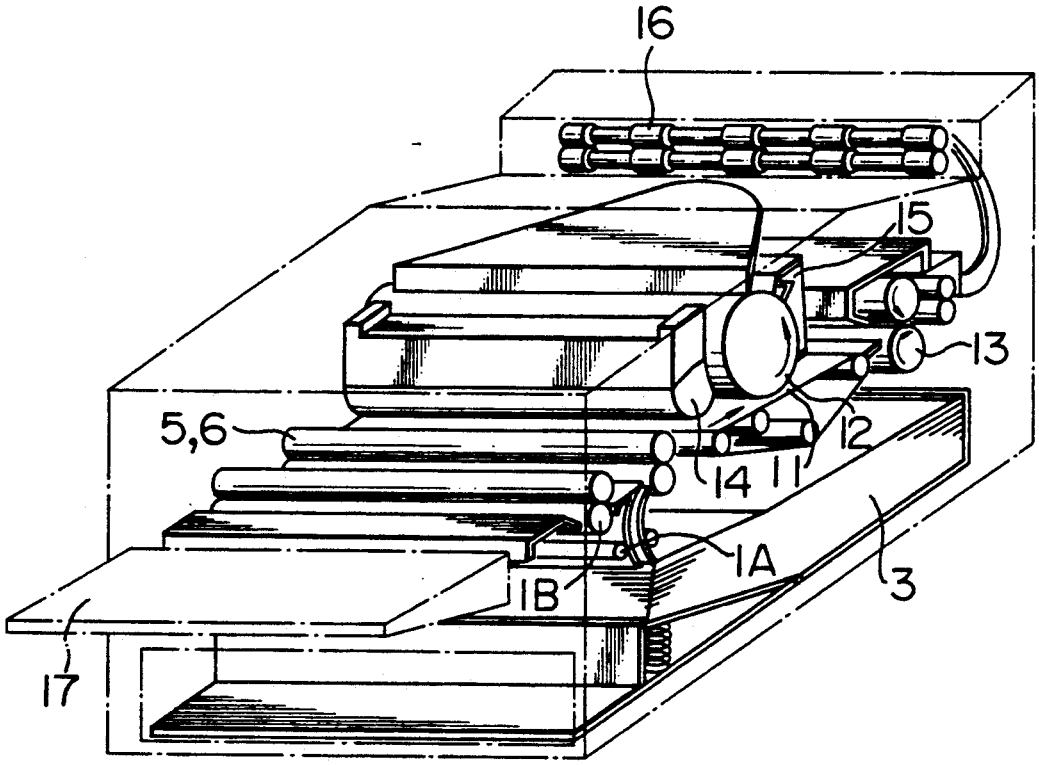
FIG. 1 is a schematic oblique projection view showing an embodiment of the present invention.

As shown in FIG. 1, sheets 3 are received at a bottom portion of a printing device. A pick-up roller device (not shown) is arranged adjacent to an end of the sheets 3 to supply one of the sheets 3 to a pair of supply rollers 1A. The picked up sheet 3 is fed by the supply rollers 1A toward a pair of feed rollers 5 and 6 through a lower guide plate 2 and an upper guide plate 4. After the sheet 3 passes the pair of feed rollers 5 and 6, an endless transferring belt 11 running on pullies supports transfers the sheet 3. A cylindrical photosensitive member 12 contacts with an upper surface of the sheet 3. After the sheet 3 passes the cylindrical photosensitive member 12, the sheet 3 is brought out from the printing device by an outlet roller device 16 through a fixing device 13 arranged adjacent to a downstream side of the endless transferring belt 11. A developing device 14 is arranged closely adjacent to the cylindrical photosensitive member 12 between the cylindrical photosensitive member 12 and the pair of feed rollers 5 and 6. A cleaner 15 is arranged adjacent to a circumferential surface of the cylindrical photosensitive member 12 to clean the circumferential surface after passing a contacting portion with the upper surface of the sheet 3. When the sheet 3 is inserted manually into the printing device through a guide plate 17, the sheet 3 is fed by a pair of supply rollers 1B toward the pair of feed rollers 5 and 6.

The feed rollers 5 and 6 contact with each other to form a contacting line therebetween and the rotational axes of the feed rollers 5 and 6 are parallel to the rotational axes of the supply rollers 1A and 1B, the cylindrical photosensitive member 12 and the pullies on which the endless transferring belt 11 runs. The supply rollers 1A contact with each other to form a contacting line therebetween and at least one of the supply rollers 1A is rotated by a A motor 8 (not shown). The feed roller 5 is rotated by a B motor 9 (not shown). Gears 7 are mounted on the feed rollers 5 and 6, respectively, and engage with each other to transmit a rotational torque of the feed roller 5 to the feed roller 6. The A motor 8 and the B motor 9 are controlled by a control device 10. A sensor 18 (not shown) is arranged between the supply rollers 1A, 1B and the feed rollers 5, 6 to examine whether or not the sheet 3 exists between the supply rollers 1A, 1B and the feed rollers 5, 6.

When a sheet feed operation is started, the sheet 3 is supplied to the supply rollers 1A by the pickup roller device (not shown) and is subsequently fed toward the pair of feed rollers 5, 6 by the supply rollers 1A. After an attitude of the sheet 3 is corrected between the pair of feed rollers 5, 6 and the supply rollers 1A, the sheet 3 is fed by the pair of feed rollers 5, 6 to the transferring belt 11. A printed image carried on a surface of the cylindrical photosensitive member 12 is transferred by a transferring device (not shown) to the surface of the sheet 3 which is supported and fed on the transferring belt 11 and contacts with the cylindrical photosensitive member 12. Thereafter, the printed image on the sheet 3 is fed to the fixing device 13 by the transferring belt 11 and the image becomes fixed to the surface of the sheet 3. The outlet roller device 16 brings out the sheet 3 from an upper surface of the printing device. When the sheet 3 is inserted into the printing device manually through the guide plate 17, the attitude of the sheet 3 is corrected between the pair of feed rollers 5, 6 and the supply rollers 1B.

The principle of correcting the attitude of the sheet according to the present invention as will be explained below in greater detail can be applied to a case in which the sheet is guided along a curved guide line. When the sheet is guided along the curved guide line and the attitude of the sheet is corrected, a supplied length of the sheet between the pair of feed rollers and the supply rollers is larger than a curved distance along the curved guide between the pair of feed rollers and the supply rollers so that the curvature of the sheet is formed over the curved guide with an excess length therebetween.

Figure 2:
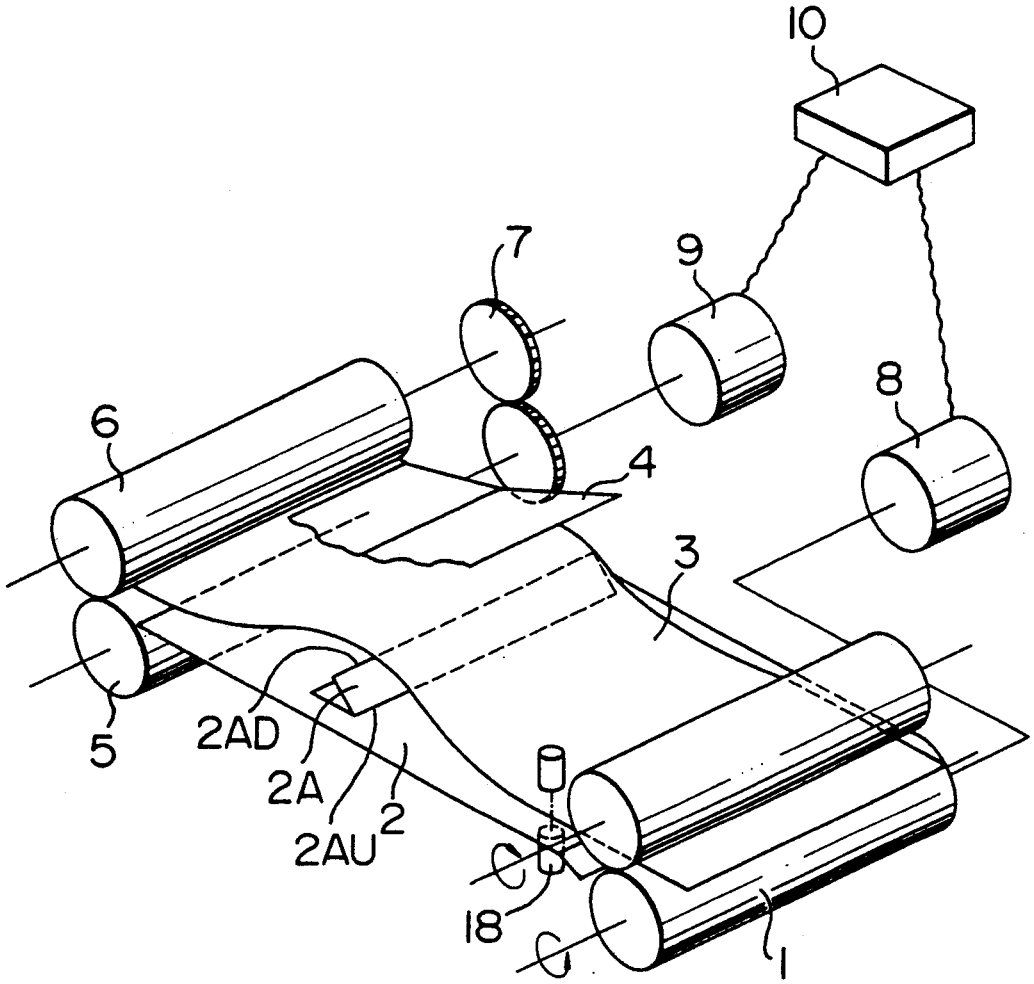
FIG. 2 is a schematic oblique projection view showing an arrangement of a pair of feed rollers and a sheet supply means.

In FIG. 2, a pair of supply rollers 1 corresponding to the pair of supply rollers 1A or 1B is rotated by the A motor 8 driving one of the supply rollers 1. The lower guide plate 2 guides or supports the sheet extending from a contacting line between the supply rollers 1 toward the contacting line between the feed rollers 5 and 6 whose rotational axes are parallel to those of the supply rollers 1. The gears 7 are mounted on the feed rollers 5 and 6, respectively, so that the torque applied to one of the feed rollers by the B motor 9 is transmitted to another one of the feed rollers. The upper guide plate 4 arranged adjacent to the feed rollers 5 and 6 over the lower guide plate 2 limits an upward movement of the sheet 3. The sensor 18 is arranged between the pair of supply rollers 1 and the pair of feed rollers 5 and 6. The control device 10 controls the A motor 8 and the B motor 9 on the basis of output signals of the sensor 18.

The upper guide plate 4 and the lower guide plate 2 are fixed to side plates (not shown). A curvature guide plate 2A extends upward from an upper surface of the lower guide plate 2 so that a forward end of the sheet 3 moving from the pair of supply rollers 1 rotated by the A motor 8 toward the pair of feed rollers 5 and 6 is smoothly moved upward and a curvature of the sheet 3 is easily formed. The forward end of the sheet 3 which is moved upward proceeds between the upper guide plate 4 and the lower guide plate 2 toward the contacting line between the pair of feed rollers 5 and 6 and the curvature of the sheet 3 is formed between the pair of feed rollers 5 and 6 and the pair of supply rollers 1.

Figure 3:
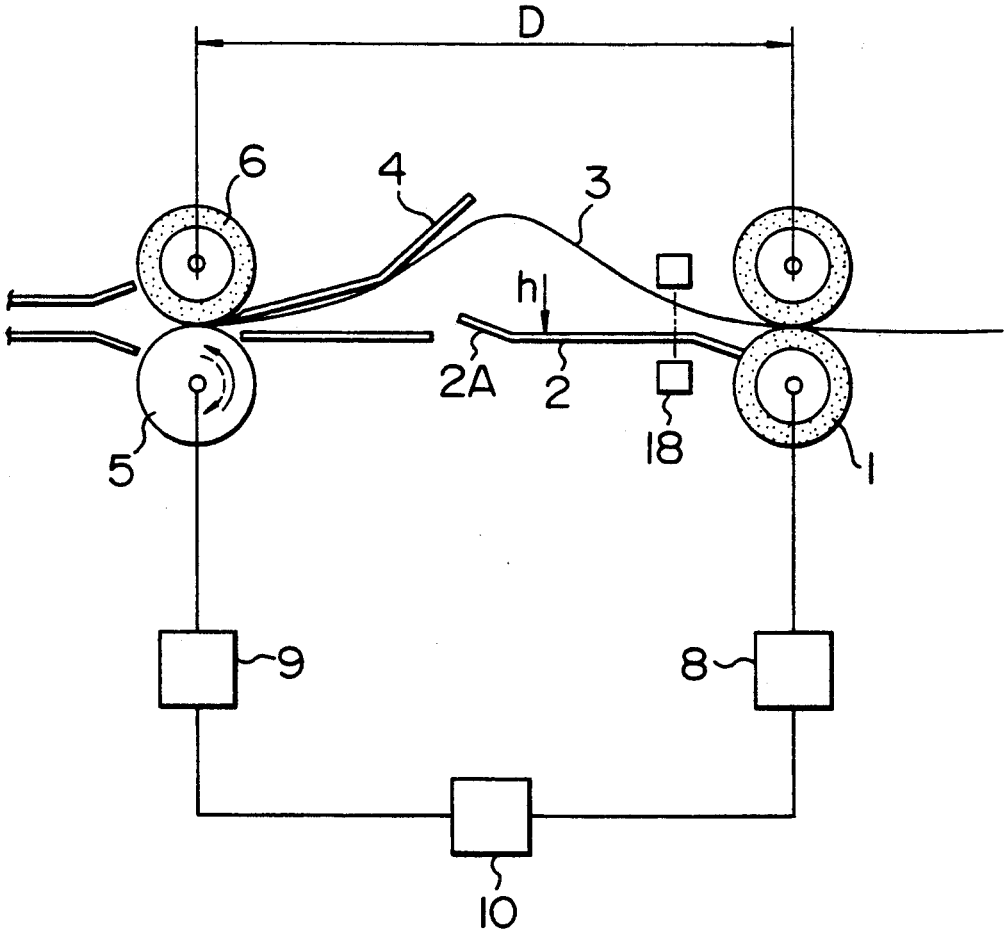
FIG. 3 is a cross-sectional view of the arrangement shown in FIG. 2.

When the forward end of the sheet 3 driven by the pair of supply rollers 1 toward the pair of feed rollers 5 and 6 reaches the sensor 18, the sensor 18 outputs a signal to the control device 10. The pair of supply rollers 1 continues to rotate for a predetermined time after the sensor 18 has provided the output signal and the pair of feed rollers 5 and 6 continue to be stationary so that the forward end of the sheet 3 can reach the pair of feed rollers 5 and 6 through a space between the upper guide plate 4 and the lower guide plate 2 and the curvature of the sheet 3, as shown in FIG. 3, can be formed between the pair of supply rollers 1 and the pair of feed rollers 5 and 6 through the curvature guide plate 2A. After a rotation of the pair of supply rollers 1 is stopped, the pair of feed rollers 5 and 6 rotates in the backward direction to urge the forward end of the sheet 3 toward the pair of supply rollers 1 for a predetermined time. Degree of the rotations of the pair of supply rollers 1 and of the pair of feed rollers 5 and 6 are limited by time in this embodiment, but the rotation may be limited directly in terms of the rotational angles thereof. The forward end of the sheet 3 proceeds into a wedge-shaped space between the feed rollers 5 and 6. Since the forward end of the sheet 3 reaches the pair of feed rollers 5 and 6 after the curvature of the sheet 3 is formed between the pair of supply rollers 1 and the pair of feed rollers 5 and 6 through the curvature guide plate 2A, an impact force between the forward end of the sheet 3 and the pair of feed rollers 5 and 6 is small and a height of the curvature of the sheet 3 can smoothly increase. Therefore, the sheet 3 does not vibrate vertically, wrinkles of the sheet 3 are prevented and a force holding the forward end of the sheet 3 fitted in the wedge-shaped space between the feed rollers 5 and 6 is small.

The B motor 9 is controlled by the control device 10 to rotate in a forward direction or a backward direction or to stop. When the rotation of the B motor 9 is prevented by the control device 10, a suitable braking torque is maintained so that the feed rollers 5 and 6 are not rotated by the forward end of the sheet 3. On a first contact between the forward end of the sheet 3 and the pair of feed rollers 5 and 6, usually, only one portion of the forward end side of the sheet 3 can contact with the pair of feed rollers 5 and 6 and it is difficult for two portions of the forward end side of the sheet 3 to contact with the pair of feed rollers 5 and 6. The force holding the one portion of the forward end side of the sheet 3 fitted in the wedge-shaped space between the feed rollers 5 and 6 prevents the forward end side of the sheet 3 from moving freely to contact another portion of the forward end side with the pair of feed rollers 5 and 6.

After the first contact is made between the forward end of the sheet 3 and the pair of feed rollers 5 and 6, the pair of feed rollers 5 and 6 is rotated backward so that the force holding the one portion of the forward end side of the sheet 3 fitted in the wedge-shaped space decreases largely and the forward end side of the sheet 3 can be moved easily and stably by the rigidity against the curvature of the sheet 3 to contact at least two portions of the forward end side of the sheet 3 with the pair of feed rollers 5 and 6. When a distance D between the pair of feed rollers 5 and 6 and the supply rollers 1 is 150 mm and outer diameters of the feed rollers 5 and 6 are 20 mm, a preferable angle of the feed rollers 5 and 6 rotated in a backward moving direction is about 60 degrees. Since the upper guide plate 4 presses downward an intermediate position of the sheet 3 to make an forward portion of the sheet 3 extend substantially horizontally toward the contact line between the pair of the feed rollers 5 and 6 when the pair of feed rollers 5 and 6 is rotated backward, the forward end of the sheet 3 cannot move far away from the contacting line. And since the highest position of the curvature of the sheet 3 does not become in contact with the upper guide plate 4, the rigidity of the sheet 3 against the curvature thereof is effectively used to urge the forward end of the sheet 3 toward the contacting line so that the forward end side of the sheet 3 can be moved securely.

After the pair of feed rollers 5 and 6 is rotated in the backward direction by a preferred angular amount, they may be stopped for a time so that at least the two portions of the forward end side of the sheet 3 can correctly be in contact with the pair of feed rollers 5 and 6 and a clamp of the forward end side of the sheet 3 at the contacting line by the pair of feed rollers 5 and 6 is securely prevented.

Subsequently, the pair of feed rollers 5 and 6 and the supply rollers 1 begin to be rotated in the forward direction by the A motor 8 and the B motor 9, respectively, so that the forward end of the sheet 3 proceeds to the transferring device through the contacting line.

A smooth outer peripheral surface of the feed roller 5 is made of metal and an outer peripheral surface of the feed roller 6 is made of rubber. A feed speed of the sheet 3 is preferably about 125 to 254 mm/s. A forward feed speed of the sheet 3 by the pair of feed rollers 5 and 6 may be different from a backward speed thereof.

Figure 4:
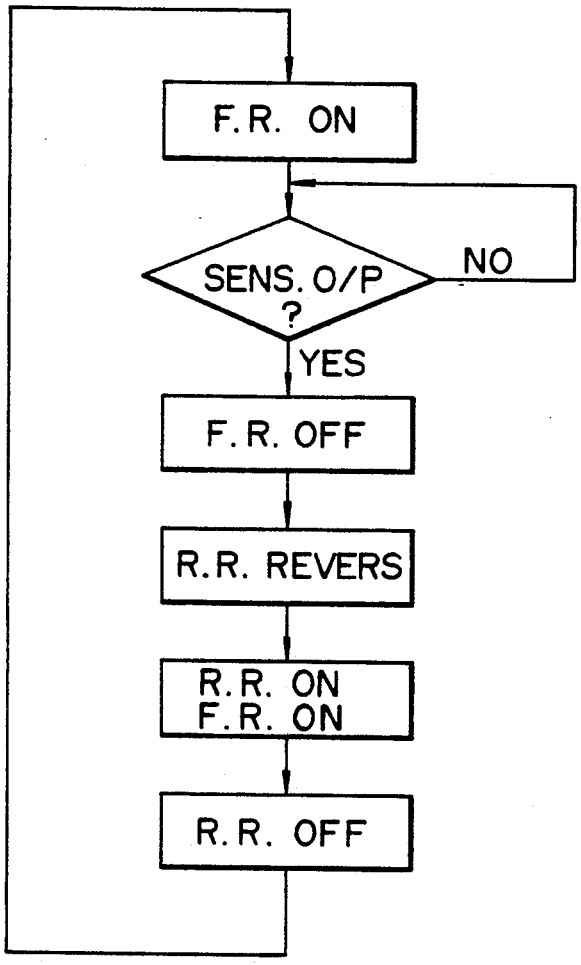
FIG. 4 is a diagram showing a flowchart for controlling the embodiment of the present invention.
Figure 5:
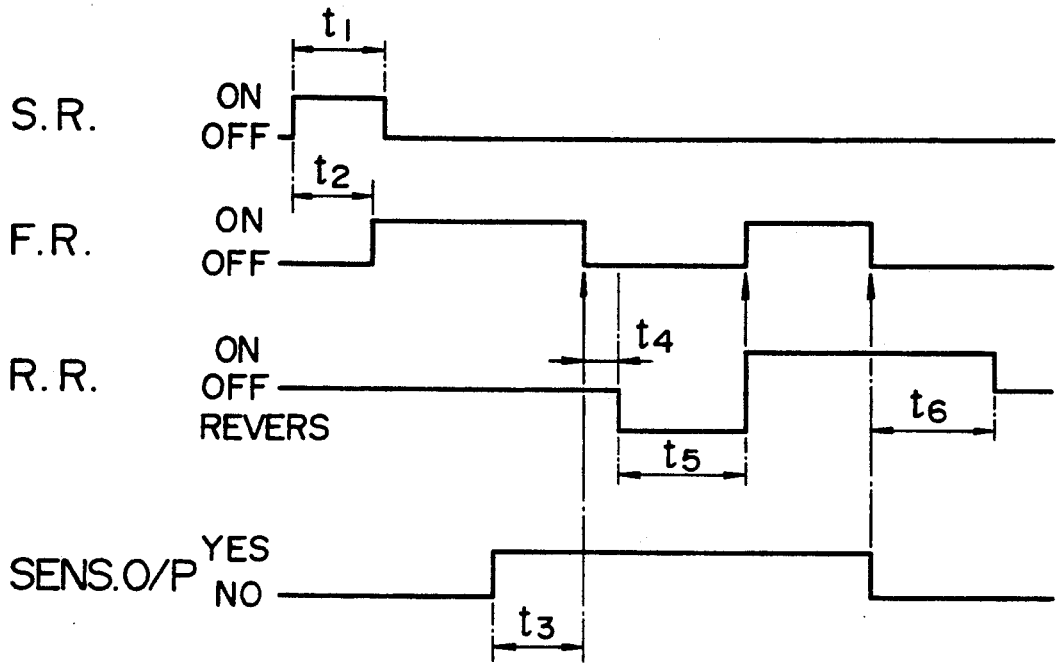
FIGS. 5 and 6 are diagram showing respective control methods for bringing the present invention into effect.

FIG. 4 shows a flow chart for controlling the embodiment of the present invention. FIG. 5 shows actions of the supply rollers 1, the pair of feed rollers 5 and 6 and the sensor 18 in relation to time. In FIGS. 4 and 5, S.R, F.R and R.R indicate rotations of the pick-up roller device, the supply roller 1 and the feed rollers 5 and 6, respectively, and ON, OFF and REVERSE indicate the forward rotation, the stoppage and the backward direction of rotation thereof respectively. SENS.O/P indicates the output of the sensor 18, and YES indicates the existance of the sheet 3 examined by the sensor 18 and NO indicates the empty thereof examined by the sensor 18.

When the feed operation is started, the pickup roller device is rotated for a time $t_1$ to supply the sheet 3 to the supply rollers 1. When a time $t_2$ has passed after the pick-up roller device begins to be rotated, the supply rollers 1 begin to be rotated to supply the sheet 3 to the pair of feed rollers 5 and 6. The time $t_1$ is determined in accordance with a length of the sheet 3 to finish the pass of the sheet 3 at the pick-up roller device. The sensor 18 outputs a signal for indicating a pass of the sheet 3 at the sensor 18 after the forward end of the sheet 3 passes the supply rollers 1. When a time $t_3$ has passed after the output signal of the sensor 18, the rotation of the supply rollers 1 is stopped. In this case, the time $t_3$ is determined on the basis of a time for contacting the forward end of the sheet 3 with the feed rollers 5 and 6 and forming the suitable curvature of the sheet 3 between the pair of the feed rollers 5 and 6 and the supply rollers 1. When a small time $t_4$ has passed after the rotation of the supply rollers 1 is stopped, the pair of the feed rollers 5 and 6 which are not rotated before the supply rollers 1 are stopped begins to rotate int he backward direction for a time $t_5$. If the pair of the feed rollers 5 and 6 which is not rotated before the forward end of the sheet 3 becomes in contact with the pair of the feed rollers 5 and 6 begins to be rotated in a backward direction after the forward end of the sheet 3 becomes in contact with the feed rollers 5 and 6 and the suitable curvature of the sheet 3 is formed between the pair of the feed rollers 5 and 6 and the supply rollers 1, the time $t_4$ may be equal to or less than zero. The time $t_5$ may be less than 40 ms in this case. When the time $t_5$ has passed, the pair of the feed rollers 5 and 6 and the supply rollers 1 begin to be rotated in the forward direction. Before the pair of the feed rollers 5 and 6 begins to be rotated in the forward direction, the pair of the feed rollers 5 and 6 and/or the supply rollers 1 may be stopped for a time more than zero so that the movement of the forward end side of the sheet 3 is stabilized. After the output signal of the sensor 18 indicates the empty of the sheet 3 at the sensor 18, the supply rollers 1 are stopped. When a time $t_6$ has passed after the supply rollers 1 are stopped, the pair of the feed rollers 5 and 6 is stopped.

Figure 6:
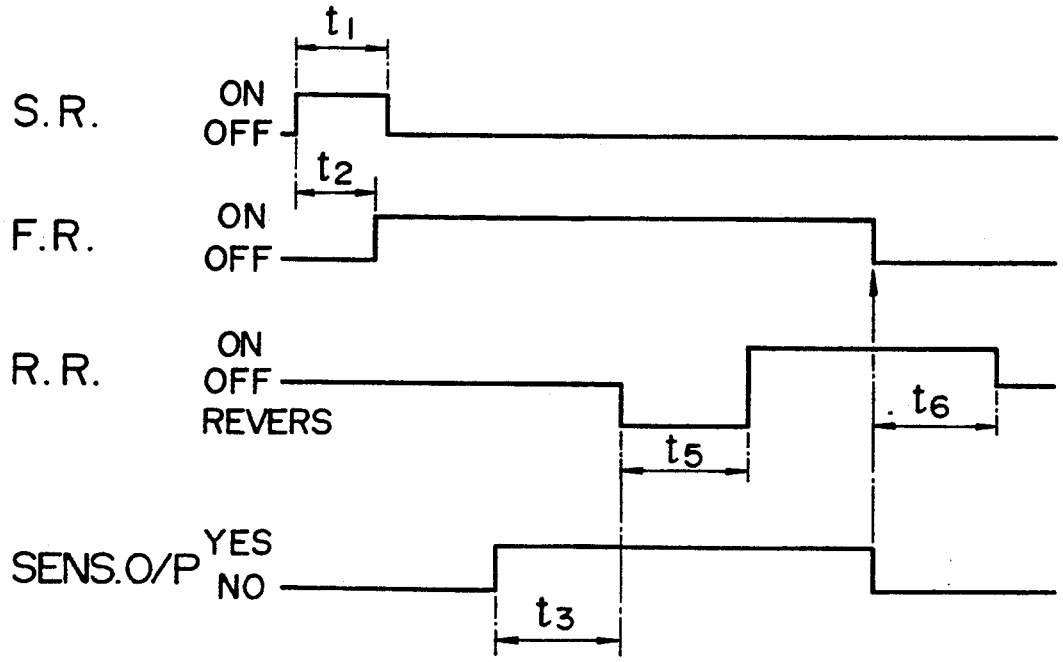

As shown in FIG. 6, if the pair of the feed rollers 5 and 6 which has been stopped begins rotating backward in the direction after the forward end of the sheet 3 contacts with the stopping feed rollers 5 and 6 and the suitable curvature of the sheet 3 is formed between the pair of the feed rollers 5 and 6 and the supply rollers 1, the supply rollers 1 may continue to rotate in the forward direction when the pair of the feed rollers 5 and 6 is rotated in the backward direction. In this case, the time 3 is determined on the basis of a time for contacting the forward end of the sheet 3 with the feed rollers 5 and 6 and forming the suitable curvature of the sheet 3 between the pair of the feed rollers 5 and 6 and the supply rollers 1.

What is claimed is:

1. A method for correcting a direction of a side of a transferred sheet comprising:

a first step in which the sheet is driven in a forward direction at a driven portion thereof other than a forward end thereof when a pair of feed rollers contacting with each other to form a contacting line therebetween is rotationally stopped, until the forward end of the sheet contacts with the pair of feed rollers near to the contacting line to be positioned by the stopped feed rollers and a curvature of the sheet is formed between the forward end thereof and the driven portion with a clearance over a guide for the sheet so that a rigidity of the sheet against the curvature thereof generates a pressing force between a forward end of the sheet and the pair of feed rollers, a second step, following the first step, in which the pair of feed rollers is rotated in a backward direction so that the forward end of the sheet is urged backward and the curvature of the sheet is maintained with the clearance over the guide for the sheet, and a third step, following the second step, in which the pair of feed rollers is rotated in a forward direction so that the sheet is fed forward.

2. A method according to claim 1, wherein a rotational speed of the pair of feed rollers is maintained substantially at zero for a time between the second step and the third step so that the movement of the forward end of the sheet is more stabilized.

3. A method according to claim 1, wherein the pair of feed rollers begins to be rotated in the forward direction, without a lag time range at zero-speed of the pair of feed rollers, after the pair of feed rollers is rotated in the backward direction.

4. A method according to claim 1, wherein in the the second step, the sheet continues to be driven forward at the driven portion thereof.

5. A method according to claim 1, wherein in the second step, the driving of the sheet at the driven portion thereof is stopped.

6. A device for correcting a direction of a side of a transferred sheet comprising:

a pair of feed rollers contacting with each other to form a contacting line therebetween, drive means for selectively rotating the feed rollers in a forward direction, rotating the feed rollers in a reverse direction and stopping rotation of the feed rollers, supply means arranged apart from the contacting line for pressing the sheet forward so that a forward end of the sheet is moved toward the contacting line,; and control means for operating the feed roller drive means and the supply means such that the supply means presses the sheet forward when the pair of feed rollers is rotationally stopped, until a forward end of the sheet contacts with the pair of feed rollers near to the contacting line and a curvature of the sheet is formed with a clearance over a guide for the sheet so that a rigidity of the sheet against the curvature of the sheet generates a pressing force between the sheet and the pair of feed rollers, thereafter, the pair of feed rollers is rotated in a backward direction so that the forward end of the sheet is urged backward and the supply means maintains the curvature of the sheet with the clearance over the guide for the sheet, and thereafter, the pair of feed rollers is rotated forward so that the sheet is fed forward.

7. A device according to claim 6, wherein said control means operates said feed roller drive means such that a rotational speed of the pair of feed rollers is maintained substantially at zero for a time range more than zero after the pair of feed rollers is rotated in the backward direction so that the movement of the forward end of the sheet is more stabilized, and subsequently the pair of feed rollers is rotated in the forward direction.

8. A device according to claim 6, wherein said control means operates said feed roller drive means such that the pair of feed rollers begins to be rotated in the forward direction, without a lag time range at zero-speed of the pair of feed rollers, after the pair of feed rollers is rotated in the backward direction.

9. A device according to claim 6, wherein said control means operates said supply means such that the forward pressing of the sheet by the supply means is stopped when the pair of feed rollers is rotated in the backward direction.

10. A device according to claim 9, wherein the supply means includes supply rollers contacting each other and controllably driving the sheet in the forward direction towards said pair of feed rollers along a guided path which includes an upwardly curved guide extended from an upper surface of a horizontal guide plate for effecting curvature of the sheet and an upper guide plate for guiding the front portion of the sheet toward the contact line of the pair of feed rollers, said upper guide plate during the backward rotation of the pair of feed rollers pressing downward at an intermediate position of the sheet thereby making the forward portion of the sheet extend substantially horizontally toward the contact line between the pair of feed rollers.

11. A device according to claim 6, wherein said control means operates said supply means such that the forward pressing of the sheet by the supply means is continued when the pair of feed rollers is rotated backward.

12. A device according to claim 11, wherein the supply means includes supply rollers contacting each other and controllably driving the sheet in the forward direction towards said pair of feed rollers along a guided path which includes an upwardly curved guide extended from an upper surface of a horizontal guide plate for effecting curvature of the sheet and an upper guide plate for guiding the front portion of the sheet toward the contact line of the pair of feed rollers, said upper guide plate during the backward rotation of the pair of feed rollers pressing downward at an intermediate position of the sheet thereby making the forward portion of the sheet extend substantially horizontally toward the contact line between the pair of feed rollers.

13. A device according to claim 6, wherein the supply means includes supply rollers contacting each other and controllably driving the sheet in the forward direction towards said pair of feed rollers along a guided path which includes an upwardly curved guide extended from an upper surface of a horizontal guide plate for effecting curvature of the sheet and an upper guide plate for guiding the front portion of the sheet toward the contact line of the pair of feed rollers, said upper guide plate during the backward rotation of the pair of feed rollers pressing downward at an intermediate position of the sheet thereby making the forward portion of the sheet extend substantially horizontal toward the contact line between the pair of feed rollers.

14. A method for correcting a direction of a side of a sheet being controllably transferred to a pair of feed rollers by supply rollers along a guided path comprising:

a first step in which the sheet is driven by the supply rollers in the forward direction at a driven portion thereof other than a forward end thereof when a pair of feed rollers contacting with each other to form a contacting line therebetween is rotationally stopped, until the forward end of the sheet contacts with the pair of feed rollers near to the contacting line and a curvature of the sheet is formed between the forward end thereof and the driven portion with a clearance over a guide for the sheet so that a rigidity of the sheet against the curvature thereof generates a pressing force between the forward end of the sheet and the pair of feed rollers, a second step, following the first step, in which the pair of feed rollers is rotated in the backward direction so that the forward end of the sheet is urged backward and the curvature of the sheet is maintained with the clearance over the guide for the sheet, and a third step, following the second step, in which at least the pair of feed roller is rotated in the forward direction so that the sheet is feed forward.

15. A method according to claim 14, wherein a rotational speed of supply rollers and the pair of feed rollers is maintained substantially at zero for a time between the second step and the third step so that the movement of the forward end of the sheet is more stabilized.

16. A method according to claim 14, wherein the pair of feed rollers begins to be rotated in the forward direction, without a lag time range at zero-spaced of the pair of feed rollers, after the pair of feed rollers is rotated in the backward direction.

17. A method according to claim 14, wherein in the second step, the sheet continues to be driven forward at the driven portion thereof by the supply rollers.

18. A method according to claim 14, wherein in the second step, the driving of the sheet at the driven portion thereof by the supply rollers is stopped.

19. A method according to claim 14, wherein a rotational speed of the pair of feed rollers only is maintained substantially at zero for a time between the second step and the third step so that the movement of the forward end of the sheet is more stabilized.

* * * * *